US007261847B2

(12) United States Patent
Mazzanti

(10) Patent No.: US 7,261,847 B2
(45) Date of Patent: Aug. 28, 2007

(54) PROCESS FOR THE FUNCTIONAL REGENERATION OF THE POROSITY OF MOULDS USED FOR MOULDING CERAMIC OBJECTS

(75) Inventor: Vasco Mazzanti, Imola (IT)

(73) Assignee: Sacmi Cooperativa Meccanici Imola Societa' Cooperativa, Bologna (IT)

( * ) Notice: Subject to any disclaimer, the term of this patent is extended or adjusted under 35 U.S.C. 154(b) by 525 days.

(21) Appl. No.: 10/333,412

(22) PCT Filed: May 21, 2002

(86) PCT No.: PCT/IB02/01738

§ 371 (c)(1),
(2), (4) Date: Jan. 21, 2003

(87) PCT Pub. No.: WO02/094524

PCT Pub. Date: Nov. 28, 2002

(65) Prior Publication Data

US 2004/0021239 A1 Feb. 5, 2004

(30) Foreign Application Priority Data

May 21, 2001 (EP) ..... 01830325

(51) Int. Cl.

| | |
|---|---|
| ***B08B 9/00*** | (2006.01) |
| ***B08B 3/08*** | (2006.01) |
| ***B28B 1/26*** | (2006.01) |
| *B28B 7/10* | (2006.01) |

(52) U.S. Cl. ..... 264/39; 134/29; 134/26; 264/651

(58) Field of Classification Search ..... 264/39, 264/651; 134/29

See application file for complete search history.

(56) References Cited

U.S. PATENT DOCUMENTS

| | | | | |
|---|---|---|---|---|
| 3,156,751 | A * | 11/1964 | Valdes et al. | 264/219 |
| 3,489,608 | A * | 1/1970 | Jacobs et al. | 134/25.4 |
| 4,076,779 | A | 2/1978 | Skriletz | |
| 4,119,108 | A * | 10/1978 | Alexander | 134/62 |
| 4,248,637 | A | 2/1981 | Mathieu | |
| 4,432,808 | A * | 2/1984 | Heubusch | 134/3 |
| 5,427,722 | A * | 6/1995 | Fouts et al. | 264/87 |
| 5,490,882 | A * | 2/1996 | Sachs et al. | 134/1 |
| 6,004,915 | A * | 12/1999 | Elliott et al. | 510/135 |
| 6,096,270 | A * | 8/2000 | Rapkin et al. | 422/61 |
| 6,214,784 | B1 * | 4/2001 | Robbins et al. | 510/423 |

FOREIGN PATENT DOCUMENTS

| | | |
|---|---|---|
| EP | 0 034 217 A1 | 8/1981 |
| EP | 0 463 179 A1 | 1/1992 |

* cited by examiner

*Primary Examiner*—Christina Johnson
*Assistant Examiner*—Matthew J. Daniels
(74) *Attorney, Agent, or Firm*—Squire, Sanders & Dempsey L.L.P.

(57) ABSTRACT

A process for the functional regeneration of the porosity of the materials used to make molds (2) for moulding ceramic objects, when the pores have been damaged by use of the mold (2), comprises the sequential execution of at least two successive steps of an ordered sequence which includes the steps of: eliminating contamination caused by organic substances form the mold (2); eliminating contamination of biological origin from the mold (2); attacking inorganic encrustations and eliminating inorganic substances which have infiltrated the pores of the mold (2), the initial step of the process being preset according to the nature of a predetermined contaminating agent. A station implementing the process is also an integral part of the present invention.

19 Claims, 3 Drawing Sheets

PROCESS FOR THE FUNCTIONAL REGENERATION OF THE POROSITY OF MOULDS USED FOR MOULDING CERAMIC OBJECTS

TECHNICAL FIELD

The present invention relates to the production of ceramic objects, in particular plumbing fixtures, the objects moulded by casting a ceramic mixture (known as slip) into moulds made of porous, draining materials. In particular, the present invention relates to a process for treatment to restore the porous functionality of the material of which the moulds are made, which becomes blocked as a result of using the moulds.

BACKGROUND ART

Moulds made of porous material for the production of ceramic objects comprise one or more forming cavities, each delimited by a surface designed to form the outer surface of the ceramic object and connected to a network of drainage channels and a system for filling the forming cavity with the ceramic mixture and emptying the cavity. Special drainage manifolds and slip manifolds allow access respectively from the outside of the mould to the drainage channel system and to the mould forming cavity filling and emptying system.

Functionally, the above-mentioned moulds may be considered on a level with a draining filter in which the ceramic mixture, cast in the forming cavity in the form of a water-based suspension of extremely fine solid particles, is held and moulded, whilst the liquid fraction separates from it through the surrounding forming surface which acts as a filter screen.

In practice, such moulds are controlled by a machine which controls the moulding cycle. At particular steps of the cycle, the mould drainage system may be supplied with the so-called service fluids (water, air and washing solutions). These may be supplied in two ways, that is to say, against the current or by absorption. When supplied against the current, the service fluids are introduced into the drainage system by means of the drainage manifolds, then flow down into the forming cavity, passing through the forming surfaces. During supply with absorption, with the flow parallel with the current, the service fluids are applied on the forming surfaces and left to migrate towards the drainage system by gravity or with the aid of a vacuum.

In the plumbing industry, the raw materials used for the ceramic mixtures, that is to say, the slips, are inorganic, obtained as a result of industrial refinement or directly from natural deposits. In the latter case, they may, therefore, contain impurities due to organic substances or other mineral compounds.

Slips normally consist of clays, feldspar and silica, finely ground and dispersed in water, of the industrial type. The solid particles in these ceramic mixtures have diameters measuring between several fractions of a μm up to around 40 μm.

Therefore, if, during use, a mould made of porous material (for example, a mould made of microporous resin) is not subjected to targeted and regular maintenance treatments, the pores may be partially or completely blocked, due to the natural penetration of particles from the ceramic mixture, or the infiltration of impurities from the air and/or water used for mould operation. Moreover, the filter layer of a mould may also accidentally be damaged by contamination by substances from outside the production cycle, such as greases, oils, etc.

The effects of the substances infiltrating the pores of the mould filter screen may be classed as: biological and organic contamination; inorganic encrustations; and mixed encrustations, which combine the various types indicated above.

In the case of biological contamination, the contaminating agents are the impurities contained in the mixtures or in the mould service water, such as humus and bacterial loads in general.

As indicated, organic contamination is due to the accidental presence of greases and/or oils.

Contamination by encrustations is due to the formation of clusters as a result of the interaction of particles in the mixture with salts or oxides. The latter may be present as impurities in the raw materials and/or in the water used to prepare the mixture, or may be introduced into the mould during the various steps of the technological cycle (for example, with water during mould washing).

Document DE-2 107 018 discloses a method for moulding ceramic products where compressed air is used to dry the porous moulds.

Document GB-1 337 492 discloses a method for moulding ceramic products and describes the use of warm air to speed up the process of drying the porous moulds.

Patent application EP-A-0 463 179 discloses a high-pressure device for moulding ceramic products in porous moulds and comprising an ultrasonic unit to clean the mould.

At present there are no known processes for regeneration of the mould materials which allow the full restoration of the original microporosity of the material. Therefore, there is no remedy to the progressive deterioration in the functionality of moulds made of resin, with consequent deterioration of production conditions in the specific steps of the process in question (object forming and removal from the mould). For these reasons, after a given period of use, the moulds must be substituted.

DISCLOSURE OF THE INVENTION

The aim of the present invention is to introduce a process for regeneration of the functionality of the porosity of the materials in which the various operating steps are carefully chosen and ordered in a preset sequence, using methods which allow the systematic and complete elimination of the various contaminants and, at the same time, allow everything to be done with a high level of efficiency which guarantees a significant extension of the useful life of the moulds.

According to certain aspects of it, the present invention provides processes for the functional regeneration of the porosity of the materials used to make moulds for moulding ceramic objects as described in the independent claims.

The present invention also relates to an operating station

The dependent claims describe preferred, advantageous embodiments of the invention.

The order of some of the steps in the process surprisingly revealed a synergic enhancement of the effects produced by the individual steps which, by extending useful mould life, allows significant savings in terms of installation and operating expenses.

DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

Figure 3:
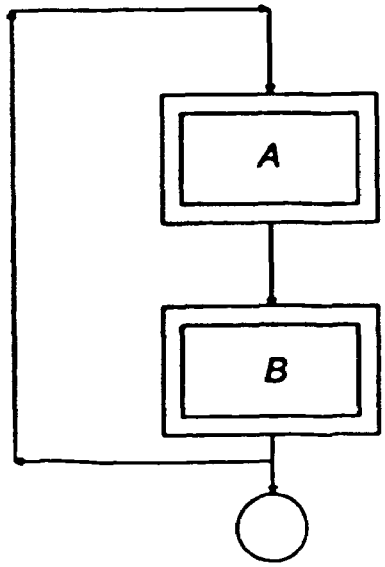
FIG. 3 is a highly schematic representation of a regeneration process suitable for regenerating porosity affected by mixed contamination.

FIG. 3 of the accompanying drawings illustrates as a whole a functional block diagram of a would treatment process, for moulds made of a porous material, for moulding ceramic objects. The process is designed to restore the original functionality of the porosity of the material, damaged by repeated use of the mould.

As mentioned above, the porosity of the mould is damaged mainly by contamination of three kinds:

organic contamination; biological and/or biorganic contamination; inorganic contamination or encrustations. The second and third types may give rise to mixed encrustations.

As indicated, organic contamination is due to the accidental presence of greases and/or oils.

In the case of biological contamination, the contaminating agents are the impurities contained in the mixtures or in the mould service water, such as humus and bacterial loads in general.

Contamination by encrustations is due to the formation of clusters as a result of the interaction of particles in the mixture with salts or oxides. The latter may be present as impurities in the raw materials and/or in the water used to prepare the mixture, or may be introduced into the mould during the various steps of the technological cycle (for example, with water during mould washing).

The process in its entirety, that is to say, when all the type of contamination mentioned above are present, comprises a first step of eliminating the contamination caused by organic substances; this step being followed by steps of eliminating the contamination of biological origin; attacking inorganic encrustations to cause their flaking, and using fluidisation to eliminate inorganic substances which have infiltrated the pores.

Figure 1:
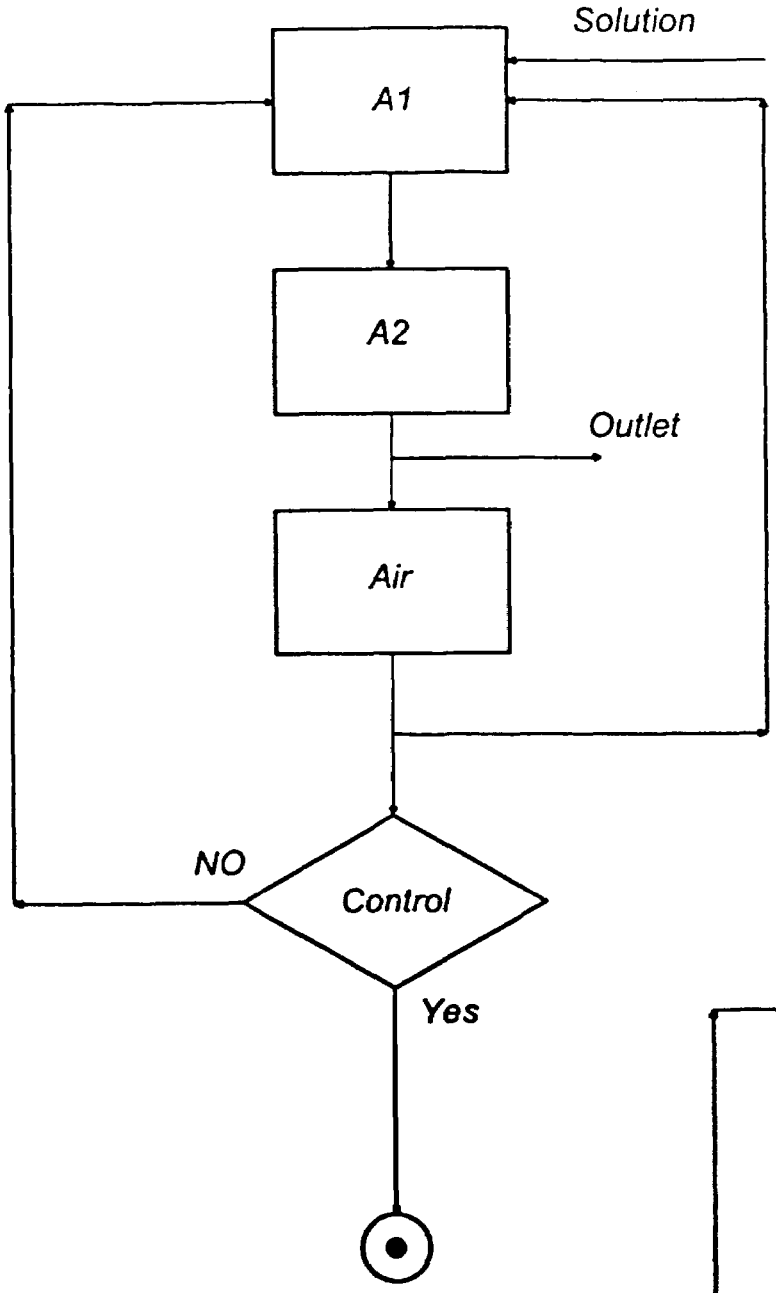
FIG. 1 is a schematic illustration of a first sequence of steps in the regeneration process, in which the porosity of the mould material affected by organic contamination is regenerated.

The first steps of eliminating contamination caused by organic substances is symbolically represented by block A in FIG. 3 and in the sequence in FIG. 1. The second, third and fourth steps are symbolically represented by block B in FIG. 3 and by the sequence in FIG. 2. It should be noted that the steps represented by block A and block B must be performed in the order shown, whilst, within block B, the sub-steps of eliminating the contamination of bological origin and attacking the inorganic encrustations need not be performed in the order shown.

The complete sequence described above involves the systematic treatment of all the types of contamination which can normally affect a mould made of microporous resin for the production of ceramic objects, preferably plumbing fixtures.

However, if there are only some types of contamination present, the steps of the process relative to elimination of the contaminating agents which are definitely absent can be omitted from the process, although the above-mentioned preset order must remain unchanged for the remaining steps.

Figure 4:
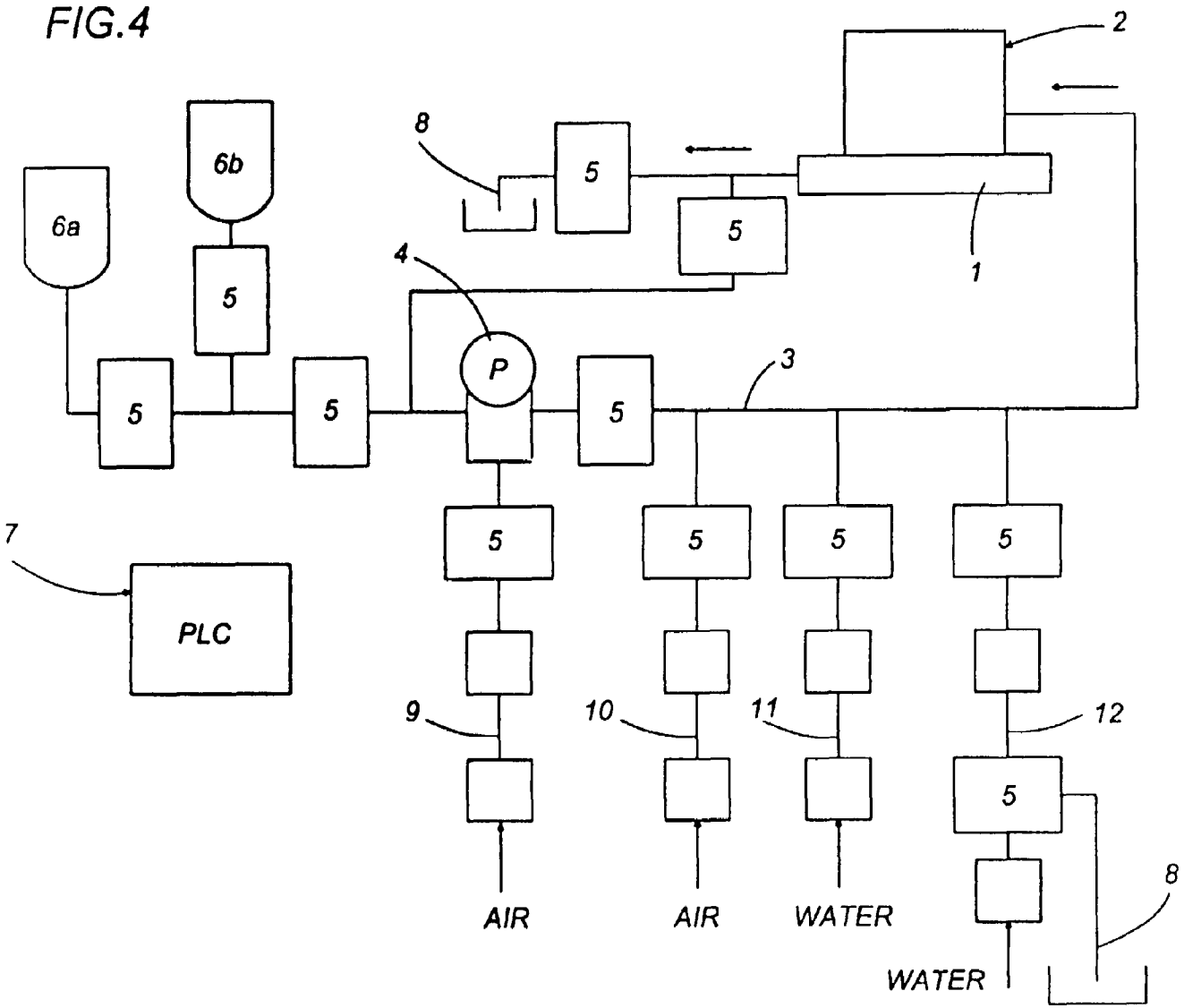
FIG. 4 is a layout diagram of an operating station in which the process in accordance with the present invention is implemented.

A special automated station (FIG. 4) controlled by programmable automatic control means—for example, a PLC—can allow, depending on the type of contaminating agent or agents, selection of the steps to be executed and selection of the starting step from which the ordered process must begin.

More specifically, eliminating contamination by organic substances (FIG. 1) includes the application to the porous mould material of a liquid flow, consisting of an alkaline fluid, such as an alkaline solution which is a mixture of detergents and surfactants. The detergents are preferably of the cationic and non-ionic type, and the surfactants are selected from the alkyl ammino polyethoxylate group.

The diagram in FIG. 1 also shows how practical elimination of contamination due to organic substances—symbolically labelled step A1—involves continuously and repeatedly applying the alkaline solution in the mould until a control condition is satisfied, which allows recirculation of the solution to be stopped. A subsequent recirculation of a washing fluid, such as pressurised water—symbolically labelled step A2—washes, rinses and removes from the mould the detergent solutions and the contaminants removed. Finally, a subsequent recirculation of a gaseous fluid, such as air, dries the pores of the material of which the mould is made and mechanically removes any residual waste remaining in the mould.

The step of eliminating contamination caused by organic substances is followed by the part of the process in which the inorganic and biological contaminants (block B in FIG. 3) are attacked.

Figure 2:
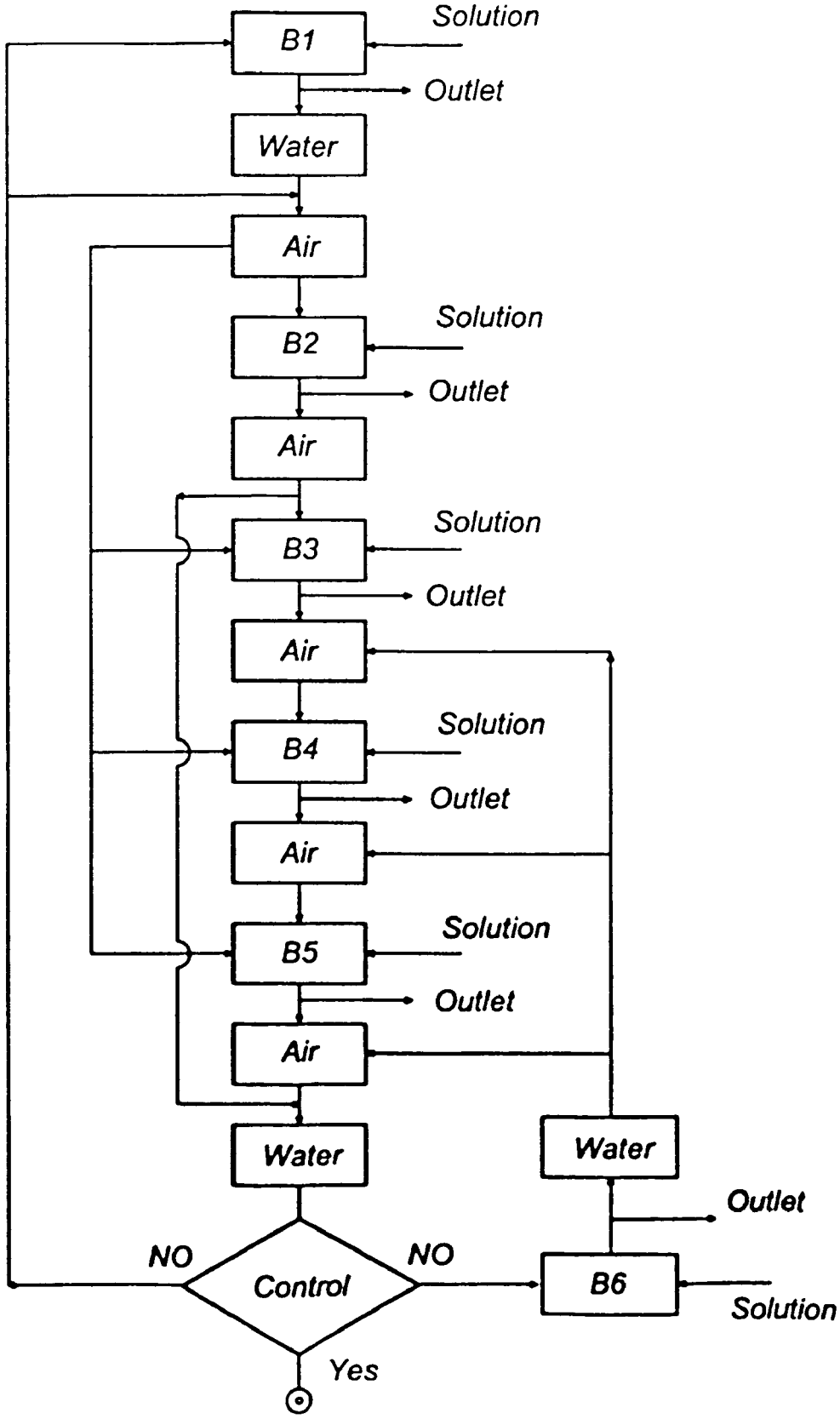
FIG. 2 is a schematic illustration of a second sequence of steps in the regeneration process, in which the functionality of the porosity of the moulds affected by inorganic and biological contamination is regenerated.

FIG. 2 clearly shows that this part of the process involves a first step of attacking the encrustations in an acidic environment—step B1, followed by a step of attacking them in an alkaline environment—step B3. Between steps B1 and B3 a disinfecting step in an alkaline environment is performed, labelled B2. Subsequent steps B4 and B5 involve a further treatment of the encrustations in an alkaline environment, whilst a step B6 performed at the end of the process allows further descaling in an acidic environment.

The step of attacking the encrustations in an acidic environment—step B1—can be performed first and the step of disinfecting in an alkaline environment—step B2—second or, where necessary, their order can be reversed.

However, step B1, by applying acidic solutions to the mould 2, also has a certain biocidal effect and thus helps to eliminate biological contaminants.

More specifically, the attack on inorganic encrustations in an acidic environment—labelled step B1—involves the repeated application to the mould, through the relative drainage system, of a first fluid with acidic pH, for example a water-based solution of a mixture of one or more acids. Said solution preferably contains acid concentrations not exceeding 10% by weight and, if necessary, assisted by the presence of active agents in an acidic environment.

The most suitable types of acids and adjuvant agents are chosen taking into the account the chemical nature of the encrustations.

For example, encrustations caused by ceramic mixtures can be treated effectively with hydrochloric acid, hydrofluoric acid, or mixtures of the two.

Other acids that may be used are sulphuric acid and nitric acid, which may be used individually or mixed with each other or with the other acids mentioned above.

The disinfecting step in an alkaline environment—step B2—may be performed by recirculating a washing fluid through the mould. Said fluid may be a washing solution containing biocidal agents compatible with the type of biological contamination in the would. For example, water-based solutions containing a biocidal substance chosen from the group consisting of sodium hypochlorite or ammonium quaternary salts have a wide range of applications as strong biocides and disinfectants.

Both the disinfecting step B2 and the descaling step in an alkaline environment B3 can advantageously be combined with sequences involving the passage of compressed air through the mould.

The other steps of the process, represented by steps B4 and B5, are for descaling the pores of the mould material—the encrustations caused by ceramic mixtures—by washing with recirculation of an alkaline fluid, such as a water-based alkaline solution.

The solution, to which fluidising agents are added, suitably chosen according to the main substances in the encrustations, can also be combined with sequences of air blown through the mould. Examples of fluidising agents suitable for ceramic mixtures are compounds such as polyphosphates and sodium and ammonium salts of polyacrylates with low molecular weight.

The further descaling step in an acidic environment—labelled B6—involves successive repeated application to the mould of a washing fluid, preferably consisting of a water-based acidic solution, or mixtures of acids, up to a concentration of 20% by weight. The agents used may be the same as in step B1.

Recirculation of water through the mould provides the final rinse of the pores of the mould material.

Obviously, the process may involve the repetition, even partial, of one or more characteristic steps, as indicated—by way of example and without limiting the scope of the present invention—in FIG. 2. Said figure illustrates how, after execution of step B6 and the subsequent step of washing with water, the drying steps may be repeated, steps B4 and B5 and the relative accessory washing and/or drying steps. Alternatively, it is possible to perform step B5 only, or even just repeat the washing and/or drying steps for the material of which the mould 2 is made. The cyclical repetition of the steps is kept active until a preset control condition is satisfied.

The mould regeneration station schematically illustrated in FIG. 3 basically comprises a treatment tank 1, above which the moulds 2 to be regenerated are positioned. A ring-shaped pipe 3 with a pump 4 delivers the washing solutions arriving from suitable feed tanks 6*a* and 6*b* under pressure to the mould 2 drainage system. They are then taken from the tank 1 and recirculated, being sent to the mould 2 again. A system of intercepting means—such as solenoid valves 5 controlled by a PLC 7—allows recirculation of the solutions used for mould 2 processing to be stopped, and allows them to be directed towards 5 an outlet 8. Pipes 9, 10, 11, 12 leading to the ring-shaped pipe 3, also equipped with suitable solenoid valves 5 with switching controlled by the PLC 7, allow the pipe 3 which conducts fluids to the mould 2 to be filled with pressurised air and/or water, upon reaching the various characteristic steps of the process described.

As regards the methods for circulation of the liquid flows, during the process various alternatives are possible. A first option is provided by the possibility of introducing washing flows into the mould drainage system and having them flow out in the forming cavity through the porous screen, emptying them from the mould through the channels used to introduce and remove the slip. The washing flow is then circulated against the current, that is to say, in the direction opposite to that in which the ceramic mixture is introduced into the forming cavity.

An alternative option is provided by the possibility of circulating the washing flow with the current, for example, by applying washing solutions directly and locally on the forming surface, that is to say, on the surface of the filtering porous screen and with the aid of a vacuum applied to the mould in such a way as to produce the desired washing flow circulation.

Below are two examples of how the process according to the invention can be applied.

EXAMPLE 1

In this example, the process according to the invention is used to regenerate a mould contaminated by organic substances, that is, grease and/or oil, and by inorganic encrustations, that is, scale formed by salts or oxides that combine with the mixtures used to form the ceramic products.

The regeneration process follows the sequence illustrated very schematically in FIG. 3.

Elimination of contamination caused by organic substances involves a first step (step A1 in FIG. 1) of applying a water-based alkaline solution containing potassium hydroxide in concentrations of up to 20% by weight. The solution is applied "with the current" to the mould to be regenerated, that is to say, and as indicated above, in the same direction as that in which the ceramic mixture is introduced into the mould.

The alkaline solution is applied discontinuously, that is, at defined intervals and without recirculation: the process cycle is set in such a way that the applications are alternated with intervals of at least 30 minutes for a time ranging from 1 hour to 24 hours.

This is followed by a step of washing away the alkaline solution (step A2 of FIG. 1). The washing step is performed by applying water under pressure with the current continuously and without recirculation for a time ranging from 10 to 30 minutes.

This is followed by a step of drying and mechanical removal (AIR step in FIG. 1) in which air under pressure is applied to the mould against the current for a time ranging from 5 to 15 minutes.

This sequence of steps can be repeated until the required result is obtained.

This is followed by another sequence of steps—labelled B as a whole in FIG. 3 and illustrated in more detail in FIG. 2—in order to eliminate the inorganic encrustations.

Next, there is a step (labelled B1 in FIG. 2) of attacking the inorganic encrustations in an acidic environment using a water-based acidic solution of hydrochloric acid in concentrations of up to 10% by weight.

This water-based acidic solution is applied by continuous recirculation "against the current" —that is to say, by circulating it in the direction opposite to that in which the ceramic mixture is introduced—for a length of time ranging from 1 to 24 hours.

This is followed by a step (the first WATER step of FIG. 2) of washing the mould using water applied under pressure discontinuously with the current and without recirculation. This step has a duration ranging from 10 to 60 minutes and is alternated with intervals of not more than 5 minutes.

This is followed by a step of drying and mechanical removal (the first AIR step in FIG. 2) in which air under pressure is applied to the mould against the current continuously for a time ranging from 5 to 15 minutes.

Since there are no biorganic or biological contaminants, the disinfecting step B2 and the related AIR step are omitted.

Next, there is a step of attacking in an alkaline environment using a water-based alkaline solution of sodium silicate in concentrations of up to 10% by weight (step B3 in FIG. 2).

The water-based alkaline solution is applied to the mould discontinuously against the current, without recirculating and alternated with air under pressure. The duration of this step ranges from 30 to 60 minutes, whilst the sub-steps of applying the compressed air have a duration of between 2 and 5 minutes.

This is followed by a step of drying and mechanical removal (the third AIR step in FIG. 2) in which air under pressure is applied to the mould against the current continuously for a time ranging from 5 to 15 minutes.

Next, there is another step of attacking in an alkaline environment using a water-based alkaline solution of sodium silicate in concentrations of up to 10% by weight (step B4 in FIG. 2).

The alkaline water-based solution is applied to the mould by recirculating it continuously against the current. The duration of this step ranges from 1 to 24 hours.

This is followed by a step of drying and mechanical removal (the fourth AIR step in FIG. 2) in which air under pressure is applied to the mould against the current continuously for a time ranging from 5 to 15 minutes.

Next, there is yet another step of attacking in an alkaline environment using an alkaline water-based solution of sodium silicate in concentrations of up to 10% by weight (step B5 in FIG. 2).

The alkaline water-based solution is applied to the mould by discontinuous recirculation against the current. The cycle is designed to ensure that the alternated fluids flow through the mould completely.

The duration of this step ranges from 1 to 24 hours.

This is followed by a step of drying and mechanical removal (the fourth AIR step in FIG. 2) in which air under pressure is applied to the mould against the current continuously for a time ranging from 5 to 15 minutes.

This is followed by a step (the second WATER step of FIG. 2) of washing the mould using water applied under pressure discontinuously with the current and without recirculation. This step has a duration ranging from 10 to 60 minutes and is alternated with intervals of not more than 5 minutes.

Next, there is a step (labelled B6 in FIG. 2) of attacking the inorganic encrustations in an acidic environment using a water-based acidic solution of hydrochloric acid in concentrations of up to 20% by weight.

The water-based acidic solution is applied discontinously with the current and without recirculation for a length of time ranging from 5 to 24 hours, alternating with intervals of at least 30 minutes.

This is followed by a step (the third WATER step of FIG. 2) of washing the mould using water applied under pressure discontinuously with the current and without recirculation. This step has a duration ranging from 10 to 60 minutes and is alternated with intervals of not more than 5 minutes.

The process can be repeated in whole or in part according to requirements and depending on the results obtained.

EXAMPLE 2

In this example, the process according to the invention is used to regenerate a mould contaminated by a biorganic or biological substance, that is, impurities contained in the mixtures or in the mould service water, such as humus and bacterial loads in general, and by inorganic encrustations, that is, scale formed by salts or oxides that combine with the ceramic mixtures.

The regeneration process follows the sequence illustrated in FIG. 2.

Elimination of inorganic encrustations and preliminary treatment of contamination caused by biorganic substances involve a first step (step B1 in FIG. 2) of applying a water-based acidic solution of hydrochloric acid in concentrations of up to 10% by weight.

This water-based acidic solution is applied by continuous recirculation "against the current" —that is to say, by circulating it in the direction opposite to that in which the ceramic mixture is introduced—for a length of time ranging from 1 to 24 hours.

This is followed by a step (the first WATER step of FIG. 2) of washing the mould using water applied under pressure discontinuously with the current and without recirculation. This step has a duration ranging from 10 to 60 minutes and is alternated with intervals of not more than 5 minutes.

This is followed by a step of drying and mechanical removal (the first AIR step in FIG. 2) in which air under pressure is applied to the mould against the current continuously for a time ranging from 5 to 15 minutes.

Next, there is an step of attacking in an alkaline environment using a water-based disinfectant solution of sodium hypochlorite in concentrations of up to 15% by weight (step B2 in FIG. 2).

This is followed by a step of drying and mechanical removal (the second AIR step in FIG. 2) in which air under pressure is applied to the mould against the current continuously for a time ranging from 5 to 15 minutes.

The water-based disinfectant solution is applied to the mould by recirculating it continuously with the current. The duration of this step ranges from 30 minutes to 5 hours.

Next, there is an step of attacking in an alkaline environment using a water-based alkaline solution of sodium silicate in concentrations of up to 10% by weight (step B3 in FIG. 2).

The water-based alkaline solution is applied to the mould discontinuously against the current, without recirculating and alternated with air under pressure. The duration of this step ranges from 30 to 60 minutes, whilst the sub-steps of applying the compressed air have a duration of between 2 and 5 minutes.

This is followed by a step of drying and mechanical removal (the third AIR step in FIG. 2) in which air under pressure is applied to the mould against the current continuously for a time ranging from 5 to 15 minutes.

Next, there is another step of attacking in an alkaline environment using a water-based alkaline solution of sodium silicate in concentrations of up to 10% by weight (step B4 in FIG. 2).

The water-based alkaline solution is applied to the mould by recirculating it continuously against the current. The duration of this step ranges from 1 to 24 hours.

This is followed by a step of drying and mechanical removal (the fourth AIR step in FIG. 2) in which air under pressure is applied to the mould against the current continuously for a time ranging from 5 to 15 minutes.

Next, there is yet another step of attacking in an alkaline environment using a water-based alkaline solution of sodium silicate in concentrations of up to 10% by weight (step B5 in FIG. 2).

The water-based alkaline solution is applied to the mould by discontinuous recirculation against the current. The cycle is designed to ensure that the alternated fluids flow through the mould completely.

The duration of this step ranges from 1 to 24 hours.

This is followed by a step of drying and mechanical removal (the fourth AIR step in FIG. 2) in which air under pressure is applied to the mould against the current continuously for a time ranging from 5 to 15 minutes.

This is followed by a step (the second WATER step of FIG. 2) of washing the mould using water applied under pressure discontinuously with the current and without recirculation. This step has a duration ranging from 10 to 60 minutes and is alternated with intervals of not more than 5 minutes.

Next, there is a step (labelled B6 in FIG. 2) of attacking the inorganic encrustations in an acidic environment using a water-based acidic solution of hydrochloric acid in concentrations of up to 20% by weight.

The water-based acidic solution is applied discontinously with the current and without recirculation for a length of time ranging from 5 to 24 hours, alternating with intervals of at least 30 minutes.

This is followed by a step (the third WATER step of FIG. 2) of washing the mould using water applied under pressure discontinuously with the current and without recirculation. This step has a duration ranging from 10 to 60 minutes and is alternated with intervals of not more than 5 minutes.

This process, too, can be repeated in whole or in part according to requirements and depending on the results obtained.

The invention as described above may be modified and adapted in several ways without thereby departing from the scope of the inventive concept as defined in the claims.

The invention claimed is:

1. A process for a functional regeneration of a porosity of materials used to make moulds for moulding ceramic objects, when pores have been clogged by use of a mould on account of contamination caused by organic substances, by inorganic encrustations and by biological substances, the process comprising the steps of:

firstly eliminating contamination by organic substances in the mould and in its pores by:

applying an alkaline solution to the mould;

flowing said alkaline solution through pores of the mould;

these steps being followed by the steps of:

applying an acidic solution to the mould;

flowing said acidic solution through the pores of the mould for eliminating contamination by inorganic substances in the mould and in its pores;

applying a disinfectant solution to the mould;

applying an alkaline fluid to the mould, in such a way as to eliminate the contamination caused by inorganic substances in the mould and in its pores; and flowing said disinfectant solution through the pores of the mould for eliminating contamination by biological substances in the mould and in its pores.

2. The process according to claim 1, wherein the alkaline fluid used in step has added to it a fluidising agent selected from the group consisting of polyphosphates and sodium and ammonium salts of polyacrylates.

3. The process according to claim 1, comprising sequential applications of a gaseous flow, following the step of applying the alkaline fluid.

4. The process according to claim 1, wherein the alkaline fluid applied to the mould (2) in step (B3; B4, B5) includes detergents selected from the group consisting of cationic and non-ionic detergents and surfactants chosen from the alkyl ammino polyethoxylate group.

5. The process according to claim 1, comprising a step of applying an acidic solution, this application step following the step of applying the alkaline fluid to the mould.

6. The process according to claim 5, wherein the acidic solution applied in step includes a water-based solution of acids or mixtures of acids in concentrations of up to 20% by weight.

7. The process according to claim 5, wherein the step of applying an acidic solution is followed by a step of washing the mould.

8. A process for a functional regeneration of a porosity of materials used to make moulds for moulding ceramic objects, when pores have been clogged by use of a mould on account of contamination caused by organic substances, by inorganic encrustations and by biological substances, the process comprising the steps of:

firstly eliminating contamination by organic substances in the mould and in its pores by applying an alkaline solution to the mould, said alkaline solution being water-based and including detergents selected from the group consisting of cationic and non-ionic detergents and surfactants chosen from the alkyl amino polyethoxylate group;

flowing said alkaline solution through pores of the mould;

these steps being followed by the steps of:

applying an acidic solution to the mould;

flowing said acidic solution through the pores of the mould for eliminating contamination by inorganic substances in the mould and in its pores;

applying a disinfectant solution to the mould; and flowing said disinfectant solution through the pores of the mould for eliminating contamination by biological substances in the mould and in its pores.

9. The process according to claim 8, comprising at least one mould washing step, using a washing fluid, following application of the alkaline solution.

10. The process according to claim 9, wherein the washing fluid is water.

11. The process according to claim 9, wherein the washing step is carried out against the current relative to the direction in which the ceramic mixture is introduced into the mould forming cavity.

12. The process according to claim 9, wherein the washing step is performed with the current, in the same direction as that in which the ceramic mixture is introduced into the mould forming cavity.

13. The process according to claim 9, wherein the washing step is performed by applying a vacuum to the mould.

14. The process according to claim 8, wherein the acidic solution is a water-based solution containing an acid or a mixture of acids in total concentrations of not more than 10% by weight.

15. The process according to claim 14 wherein the acidic solution is a water-based solution containing an acid or a mixture of acids chosen from the hydrochloric, hydrofluoric, sulphuric and nitric group of acids.

16. The process according to claim 8, comprising at least one mould washing step, using a washing fluid, following application of the acidic solution.

17. The process according to claim 8, wherein the operating steps are controlled by a programmable logic controller which is programmable according to the type of contaminants of the porosity of the material used to make the mould.

18. A process for a functional regeneration of a porosity of materials used to make moulds for moulding ceramic objects, when pores have been clogged by use of a mould on account of contamination caused by organic substances, by inorganic encrustations and by biological substances, the process comprising the steps of:

firstly eliminating contamination by organic substances in the mould and in its pores by:

applying an alkaline solution to the mould;

flowing said alkaline solution through pores of the mould;

these steps being followed by the steps of:

applying an acidic solution to the mould;

flowing said acidic solution through the pores of the mould for eliminating contamination by inorganic substances in the mould and in its pores;

applying a disinfectant solution to the mould, said disinfectant solution including a water-based solution containing a biocidal substance selected from the group consisting of sodium hypochlorite and quaternary ammonium salts; and flowing said disinfectant solution through the pores of the mould for eliminating contamination by biological substances in the mould and in its pores.

19. The process according to claim 18, wherein the water based biocidal solution is a water-based solution in which the biocidal substance is present in total concentrations of not more than 15% by weight.

* * * * *